United States Patent [19]

Kawasaki et al.

[11] 4,230,543

[45] Oct. 28, 1980

[54] CATHODE FOR ELECTROLYSIS OF AQUEOUS SOLUTION OF ALKALI METAL HALIDE

[75] Inventors: Keiji Kawasaki, Tokyo; Itsuaki Matsuda, Yokohama, both of Japan

[73] Assignee: Showa Denko K.K., Japan

[21] Appl. No.: 27,010

[22] Filed: Apr. 3, 1979

[30] Foreign Application Priority Data

Apr. 7, 1978 [JP] Japan ..... 53-40237
Sep. 11, 1978 [JP] Japan ..... 53-110672

[51] Int. Cl.[3] ..... C25B 1/36; C25B 11/04; C25D 3/56

[52] U.S. Cl. ..... 204/98; 204/43 T; 204/290 R; 204/293

[58] Field of Search ..... 204/43 T, 48, 293, 290 R, 204/290 F, 98

[56] References Cited

U.S. PATENT DOCUMENTS 4,025,405 5/1977 Dotson et al. ..... 204/98

FOREIGN PATENT DOCUMENTS 2449603 5/1976 Fed. Rep. of Germany ..... 204/290 R
238981 3/1969 U.S.S.R. ..... 204/48

OTHER PUBLICATIONS

Pulatov, Chem. Abs., vol. 66, abs. 9117y, 1967.
Lekhikoinen, Chem. Abs., vol. 66, abs. 101025g, 1967 and abs. 101031d, 1967.
Freimanis, Chem. Abs., vol. 78, abs. 51640b, 1973.

*Primary Examiner*—F. Edmundson
*Attorney, Agent, or Firm*—Wenderoth, Lind & Ponack

[57] ABSTRACT

An improved cathode for the electrolysis of an aqueous solution of an alkali metal halide, which shows a reduced hydrogen overvoltage. The cathode comprises a metallic substrate and a coating of iron or both iron and cobalt electroplated thereon from a specified electroplating bath containing iron or both iron and cobalt. A method is also provided for electrolyzing an aqueous solution of an alkali metal halide using this cathode.

12 Claims, No Drawings

CATHODE FOR ELECTROLYSIS OF AQUEOUS SOLUTION OF ALKALI METAL HALIDE

This invention relates to an improved cathode for the electrolysis of an aqueous solution of an alkali metal halide, and a method for electrolyzing an aqueous solution of an alkali metal halide using the cathode.

It is the wide practice to electrolyze an aqueous solution of an alkali metal halide in an electrolytic cell in which a cathode and an anode are placed opposite to each other. For example, it is well known to produce sodium hydroxide, hydrogen and chlorine in an electrolyzing an aqueous solution of sodium chloride in an electrolytic cell having a diaphragm, or to produce sodium chlorate by performing the above electrolysis using an electrolytic cell not containing a diaphragm. Generally, a metallic cathode is used as the cathode, and the extent of hydrogen overvoltage at its surface seriously affects the power efficiency of electrolysis. If the hydrogen overvoltage at the cathode is low, the cell voltage is correspondingly low, and the power consumption can be reduced. It is known that the hydrogen overvoltage differs according to the material which constitutes the cathode, and especially varies depending upon the material which constitutes its surface or upon the surface condition (e.g., whether it is coarse or dense). Thus, many suggestions have been made in the past to reduce hydrogen overvoltage by depositing various materials on the surface of the metallic substrate of the cathode. They include, for example, deposition of an Ni-Zn alloy on the surface of the substrate followed by removing Zn; deposition of nickel or cobalt followed by formation thereon of a coating of rhenium or ruthenium; deposition by a flame spraying method of Ni, Co, Pt or Fe, or a mixture of cobalt and zirconia, or a mixture of nickel, cobalt and aluminum; deposition by an electroplating method of an alloy of nickel, vanadium and molybdenum, or iron and iron oxide; deposition by an electroless plating method of an alloy of tungsten with nickel or cobalt; and deposition of a cutting powder of steel by a sintering method. These methods can give rise to some reduction in hydrogen overvoltage, but have the defect that the operation is complex or costly, or the deposited surface layer is uneven, brittle or readily peeled off.

It is an object of this invention to provide a cathode for the electrolysis of an aqueous solution of an alkali metal halide which is free from the defects of the methods suggested heretofore, can be manufactured at low cost, and have a considerably low hydrogen overvoltage and a high mechanical strength.

Another object of this invention is to provide a method for electrolyzing an aqueous solution of an alkali metal halide using such a cathode.

In theory, the cathode of this invention is produced by electroplating a metallic substrate in an aqueous electroplating bath of iron or both iron and cobalt to form a coating of iron or both iron and cobalt on the surface of the substrate. The electroplating bath is an aqueous solution characterized by having a pH of 2.6 to 6.0 and containing 0.1 to 1 mole/liter of an $Fe^{++}$ ion or $Fe^{++}/Co^{++}$ ion, a small amount of an additive selected from dextrin, soluble starch, poly(2-diethylaminoethyl methacrylate) and polyaluminum chloride and being free from an ammonium ion. It has been found for the first time that the use of this specified electroplating bath can effectively achieve the objects of this invention.

Techniques for electroplating iron or cobalt have long been known, and utilized to impart a dense and bright appearance or durability to various metallic articles. However, the electroplating baths used in these conventional methods do not meet the conditions for the electroplating bath used in this invention. In particular, conventional acidic electroplating baths contain an iron or cobalt ion in a higher concentration, and generally have a low pH value. Furthermore, when iron (II) salts are used as sources of an $Fe^{++}$ ion, the conventional baths, in many cases, contain an ammonium ion to increase the electric conductivity of the solution, or to obtain a harder metal deposit, ammonium sulfate or ammonium chloride is added or $FeSO_4.(NH_4)_2SO_4$ is used as the ferrous salt. In any case, these conventional electroplating baths do not simultaneously meet all of the conditions for the specified electroplating bath of this invention, and do not give cathodes having a satisfactorily low hydrogen overvoltage.

Preferred embodiments of the invention are described below in more detail.

The electroplating bath used to obtain the cathode of this invention contains an $Fe^{++}$ ion or $Fe^{++}/Co^{++}$ ion in a concentration of 0.1 to 1 mole/liter, preferably 0.5 to 0.9 mole/liter. A higher metallic ion content does not give the desirable cathode. A cathode having an alloy of iron and cobalt deposited thereon from an electroplating bath containing $Fe^{++}$ and $Co^{++}$ ions is preferred because it shows a lower hydrogen overvoltage than the one having deposited thereon iron alone. The $Co^{++}$ ion can be used in a proportion of up to about 8 moles per mole of the $Fe^{++}$ ion. However, cobalt should desirably be used in a lower proportion in view of the fact that it is higher in cost than iron. Most effectively and advantageously, the $Co^{++}$ ion is used in a proportion of 0.1 to 0.5 mole per mole of the $Fe^{++}$ ion. Any water-soluble iron (II) salts and Co (II) salts can be used as sources of these metallic ions. From the practical viewpoint, $FeSo_4.7H_2O$, $FeCl_2.4H_2O$, $CoSO_4.7H_2O$ and $CoCl_2.6H_2O$ are preferred.

To increase the electric conductivity of the electroplating bath, a water-soluble inorganic salt, such as calcium chloride, sodium sulfate or potassium chloride, may optionally be added as an auxiliary additive. The amount of the auxiliary additive is usually not more than 120 g/liter. However, the bath should not contain an ammonium ion. The presence of ammonium ion has been found to partly offset the effect of reducing the hydrogen overvoltage at the resulting cathode.

The pH of the electroplating bath should be adjusted to a range of from 2.5 to 6.0, more preferably to a range of from 3 to 5.

It has been found that according to this invention, a cathode having the desired low hydrogen overvoltage can be produced by using an electroplating bath obtained by adding a small amount of an additive selected from the group consisting of dextrin, soluble starch, poly(2-diethylaminoethyl methacrylate) and polyaluminum chloride to the aqueous solution meeting the aforesaid conditions. Poly-aluminum chloride is a colorless or pale yellowish brown clear liquid of the formula $[Al_2(OH)_nCl_{6-n}]_m$ in which $1<n<5$, and $m<10$, and is commercially available. The amount of the additive is preferably 0.5 to 10 g/liter. The presence of such an additive, in conjunction with the relatively low concentrations of metallic ions and the acidic conditions within a relatively high pH range, contributes to the production of a cathode having a low hydrogen overvoltage. The mechanism by which such an effect is exhibited has not yet been elucidated fully.

The operating conditions for electroplating are nor particularly limited. The temperature is preferably 20° to 90° C., and the current density is suitably 1 to 10 $A/dm^2$. Desirably, electroplating is carried out in an non-oxidizing atmosphere. Thus, in a preferred embodiment, an inert gas such as nitrogen gas is passed through the plating bath, and the electroplating is performed while stirring the bath.

The metallic substrate to be electroplated may be selected from those materials wich are electrically conductive, have chemical resistance to an electrolytic bath for an aqueous solution of an alkali metal halide, and permit a good adhesion of the plated layer. Iron, stainless steel, nickel, titanium, and platinum-group metals are typical examples of desirable substrates. Preferably, the substrate is subjected to a customary cleaning and roughening treatment such as degrassing, etching or blasting prior to electroplating.

As stated hereinabove, according to the present invention, a cathode having a low hydrogen overvoltage can be obtained by forming an electroplated layer or iron or both iron and cobalt on the surface of a cathodic substrate from the above-specified electroplating bath. The hydrogen overvoltage of the resulting cathode is generally about 0.2 to 0.35 V lower than that of the cathode before electroplating. The surface of the electroplated layer is slightly coarser than an electroplated layer produced from a conventional electroplating bath, but adheres firmly to the substrate and does not easily peel off.

According to another aspect of this invention, there is provided an improved method for electrolyzing an aqueous solution of an alkali metal halide. The improvement consists in using a cathode having a coating of iron or both iron and cobalt electrodeposited thereon from the aforesaid specified electroplating bath. As stated hereinabove, the electrolysis of an aqueous solution of an alkali metal halide is widely practiced on an industrial scale. Typical examples include the production of sodium chlorate by the electrolysis of an aqueous solution of sodium chloride in a diaphragm-free electrolytic cell, and the production of sodium hydroxide and chlorine by the electrolysis of an aqueous solution of sodium chloride in an electrolytic cell including a diaphragm. According to this invention, the electrolysis can be performed advantageously by using the cathode of this invention described hereinabove without particularly changing the operating conditions in these conventional electrolyzing methods. When an aqueous solution of alkali metal halide is electrolyzed by using the cathode having a lowered hydrogen overvoltage as a result of electroplating, the cell voltage decreases correspondingly to the decrease of the hydrogen overvoltage, and therefore the power consumption in electrolysis is reduced. When instead of electrolyzing an aqueous solution of an alkali metal halide at an electrolyzing voltage of 3.5 V using a mild steel cathode (cathode potential −1.49 V) not subjected to an electroplating treatment, the electrolysis is carried out by using a cathode (cathode potential −1.24 V) having a hydrogen overvoltage lowered by 0.25 V as a result of the electroplating treatment in accordance with this invention, the electrolyzing voltage becomes 3.25 V, and therefore, the power consumption can be saved by about 7%. Such a low electrolyzing voltage can be maintained during the electrolysis over a long period of time.

Working examples are given below. In these examples, iron or both iron and cobalt were electroplated on various cathodic substrates, and the cathode potentials of the resulting cathodes were measured under the conditions of electrolyzing an aqueous solution of an alkali metal halide. Under the same conditions, the cathode potential of a control cathode not subjected to electroplating was measured. The effect of decreasing the hydrogen overvoltage at the cathode of this invention was shown by the difference in cathode potential between the cathode of this invention and the control cathode. Comparative Examples were also given to illustrate the use of electroplating baths which did not meet the conditions for the electroplating bath in accordance with this invention.

The cathode potential was measured through a Luggin's capillary using a saturated calomel electrode as a reference electrode. However, in some of the examples, in which the surface of a net-type cathode was covered with an asbestos diaphragm, the cathode potential could not be directly measured. Hence, the electrolyzing voltage under the conditions of electrolyzing an aqueous solution of an alkali metal halide was measured, and the decrease of the electrolyzing voltage was regarded as the decrease of the hydrogen overvoltage at the cathode.

Table I summarizes the results of Examples 1 to 25 and Comparative Examples (1) to (9) in which a cathodic substrate was electroplated with iron, and Table II summarizes the results of Examples 101 to 112 and Comparative Examples (101) to (103) in which a cathodic substrate was electroplated with iron and cobalt. The experimental conditions were as shown below.

EXAMPLES 1 TO 21

The surface of a mild steel plate (40 mm×50 mm) as a cathodic substrate was polished with abrasive paper to clean it, and electroplated with iron in an atmosphere of nitrogen with gentle stirring using each of the electroplating baths described in the table. The pH of the electroplating bath was adjusted by adding a required amount of an aqueous sodium hydroxide solution or hydrochloric acid. As an anode, an iron plate (40 mm×50 mm) was used. A direct current of 1 Amp. (5 $A/dm^2$) was passed for 30 minutes. In Example 19, the current was 2 Amp. (10 $A/dm^2$).

Each of the resulting cathodes was placed opposite to an anode composed of a titanium plate coated with ruthenium oxide, and without providing a diaphragm, an electrolytic aqueous solution for the production of sodium chlorate containing 240 g/liter of sodium chloride, 100 g/liter of sodium chlorate and 4 g/liter of sodium hydroxide was electrolyzed at a temperature of 45° C. The effect of decreasing of the hydrogen overvoltage of each of electroplated cathodes at a current density of 10 $A/dm^2$, 20 $A/dm^2$, and 30 $A/dm^2$, respectively, as compared with the control cathode not subjected to electroplating was measured. The results are shown in the extreme right column of the table.

EXAMPLE 22

A similar experiment was performed by using a nickel plate instead of the steel plate.

EXAMPLES 23 TO 25

A mild steel net (100 mm × 100 mm; wire diameter 2.4 mm × pitch 4.5 mm) was polished with a wire brush to clean it. It was then electroplated with iron by passing a direct current of 5 Amp. (5 A/dm$^2$) for 30 minutes using an iron plate (100 mm × 100 mm) as an anode.

Asbestos was deposited on the resulting cathodic mesh to form an asbestos diaphragm method cathode. The cathode was placed opposite to an anode composed of a titanium mesh coated with ruthenium oxide, and a saturated aqueous solution of sodium chloride was electrolyzed at a temperature of 50° C. and a current density of 20 A/dm$^2$ to produce sodium hydroxide. The effect of the decreasing of the electrolyzing voltage in accordance with this invention as compared with the case of using the control cathode not subjected to electroplating was examined.

COMPARATIVE EXAMPLES (1) TO (9)

A similar experiment to that in Examples 1 to 21 was performed using a mild steel plate as a cathodic substrate except that iron electroplating baths not meeting the conditions for the plating bath of this invention were used. The conditions outside the scope of this invention are asterisked in the tables. In Comparative Example (4), $NH_4Cl$ was added as an auxiliary additive, and therefore, because of the presence of an ammonium ion, the effect of decreasing of the hydrogen overvoltage was very much reduced as compared with Example 13 which was performed under the same conditions except that the electroplating bath did not contain an ammonium ion. In other Comparative Examples, the cathodes were unsatisfactory for use in the electrolysis of an aqueous solution of an alkali metal halide because they were either ineffective, or the electroplated coating easily peeled off.

EXAMPLES 101 TO 110

An experiment was performed using a mild steel plate in the same way as in Examples 1 to 21 except that an aqueous solution containing both an iron (II) salt and a cobalt (II) salt was used as an electroplating bath.

EXAMPLES 111 AND 112

An experiment was performed using a mild steel net in the same way as in Examples 23 to 25 except that an aqueous solution containing both an iron (II) salt and a cobalt (II) salt was used as an electroplating bath.

COMPARATIVE EXAMPLES (101) to (103)

An experiment was performed in the same way as in Examples 101 to 110 except that an iron/cobalt electroplating bath having the conditions outside the scope of the invention was used in each run.

The abbreviations for the additives used in Tables I and II were as follows:

Starch: water-soluble starch
PEAEM: poly(2-diethylaminoethyl methacrylate)
PAC: poly-aluminum chloride

TABLE I

| Ex. No. | Cathode sub-strate | Aqueous electroplating bath: Iron salt, g/l (mol/l) | Auxiliary additive, g/l | Additive, g/l | pH | Temp. °C. | $H_2$ overvoltage lowering effect in (V), at current density (A/dm$^2$): 10 | 20 | 30 |
|---|---|---|---|---|---|---|---|---|---|
| 1 | Steel plate | $FeCl_2$ . 4 aq, 150 (0.75) | $CaCl_2$ . 2 aq, 112 | Dextrin, 5 | 3.5 | 70 | 0.26 | 0.29 | 0.29 |
| 2 | Steel plate | $FeCl_2$ . 4 aq 100 (0.5) | $CaCl_2$ . 2 aq, 112 | Starch, 5 | 3.0 | 70 | 0.26 | 0.30 | 0.30 |
| 3 | Steel plate | $FeCl_2$ . 4 aq, 100 (0.5) | $CaCl_2$ . 2 aq, 112 | PEAEM, 3 | 3.0 | 70 | 0.12 | 0.15 | 0.16 |
| 4 | Steel plate | $FeCl_2$ . 4 aq, 100 (0.5) | $CaCl_2$ . 2 aq, 112 | PAC, 0.6 | 3.0 | 70 | 0.16 | 0.18 | 0.18 |
| 5 | Steel plate | $FeCl_2$ . 4 aq, 100 (0.5) | $CaCl_2$ . 2 aq, 112 | Dextrin, 5 | 2.5 | 70 | 0.19 | 0.22 | 0.22 |
| 6 | Steel plate | $FeCl_2$ . 4 aq, 100 (0.5) | $CaCl_2$ . 2 aq, 112 | Dextrin, 5 | 2.8 | 70 | 0.24 | 0.25 | 0.25 |
| 7 | Steel plate | $FeCl_2$ . 4 aq, 100 (0.5) | $CaCl_2$ . 2 aq, 112 | Dextrin, 5 | 4.0 | 70 | 0.26 | 0.29 | 0.29 |
| 8 | Steel plate | $FeCl_2$ . 4 aq, 100 (0.5) | $CaCl_2$ . 2 aq, 112 | Dextrin, 5 | 5.5 | 70 | 0.25 | 0.28 | 0.28 |
| 9 | Steel plate | $FeCl_2$ . 4 aq, 20 (0.1) | $CaCl_2$ . 2 aq, 150 | Dextrin, 5 | 2.55–2.6 | 70 | 0.26 | 0.29 | 0.30 |
| 10 | Steel plate | $FeCl_2$ . 4 aq, 50 (0.25) | — | Dextrin, 5 | 3.8–4.5 | 70 | 0.25 | 0.28 | 0.28 |
| 11 | Steel plate | $FeCl_2$ . 4 aq, 100 (0.5) | — | Dextrin, 5 | 3.3–4.5 | 70 | 0.25 | 0.28 | 0.28 |
| 12 | Steel plate | $FeCl_2$ . 4 aq, 200 (1.0) | — | Dextrin, 5 | 3.2–4.2 | 70 | 0.24 | 0.26 | 0.26 |
| 13 | Steel plate | $FeCl_2$ . 4 aq, 150 (0.75) | — | Dextrin, 5 | 3.2–4.2 | 70 | 0.25 | 0.27 | 0.27 |
| 14 | Steel plate | $FeCl_2$ . 4 aq, 150 (0.75) | $CaCl_2$ . 2 aq, 300 | Dextrin, 5 | 3.2–4.2 | 70 | 0.18 | 0.20 | 0.20 |
| 15 | Steel plate | $FeCl_2$ . 4 aq, 120 (0.6) | KCl, 90 | dextrin, 5 | 4.0–4.5 | 50 | 0.27 | 0.29 | 0.30 |
| 16 | Steel plate | $FeCl_2$ . 4 aq, 120 (0.6) | KCl, 180 | Dextrin, 5 | 4.3–4.9 | 50 | 0.25 | 0.28 | 0.28 |
| 17 | Steel plate | $FeCl_2$ . 4 aq, 150 (0.75) | $CaCl_2$ . 2 aq, 112 | Dextrin, 5 | 3.1–3.8 | 30 | 0.26 | 0.29 | 0.29 |
| 18 | Steel plate | $FeSO_4$ . 7 aq, 150 (0.54) | $Na_2SO_4$, 100 | Dextrin, 5 | 3.0–3.5 | 25 | 0.14 | 0.15 | 0.15 |
| 19 | Steel plate | $FeCl_2$ . 4 aq, 100 (0.5) | $CaCl_2$ . 2 aq, 112 | Dextrin, 5 | 3.0–3.5 | 30 | 0.26 | 0.29 | 0.29 |

TABLE I-continued

| Ex. No. | Cathode sub-strate | Aqueous electroplating bath: Iron salt, g/l (mol/l) | Auxiliary additive, g/l | Additive, g/l | pH | Temp. °C. | $H_2$ overvoltage lowering effect in (V), at current density (A/dm²) 10 | 20 | 30 |
|---|---|---|---|---|---|---|---|---|---|
| 20 | Steel plate | $FeCl_2$ . 4 aq, 150 (0.75) | — | Dextrin, 1 | 3.0–4.2 | 70 | 0.25 | 0.27 | 0.27 |
| 21 | Steel plate | $FeCl_2$ . 4 aq, 150 (0.75) | — | Dextrin, 10 | 3.0–4.2 | 70 | 0.27 | 0.30 | 0.31 |
| 22 | Nickel plate | $FeCl_2$ . 4 aq, 200 (1.0) | — | Dextrin, 5 | 3.5–4.5 | 70 | 0.26 | 0.29 | 0.30 |
| 23 | Steel net | $FeCl_2$ . 4 aq, 150 (0.75) | $CaCl_2$ . 2 aq, 100 | Dextrin, 5 | 3.0–3.5 | 70 | — | 0.20 | — |
| 24 | Steel net | $FeCl_2$ . 4 aq, 150 (0.75) | $CaCl_2$ . 2 aq, 100 | PAC, 5 | 3.1–3.7 | 70 | — | 0.12 | — |
| 25 | Steel net | $FeCl_2$ . 4 aq, 200 (1.0) | — | Dextrin, 5 | 3.0–3.5 | 70 | — | 0.20 | — |
| (1) | Steel plate | $FeCl_2$ . 4 aq, 100 (0.5) | $CaCl_2$ . 2 aq, 112 | Dextrin, 5 | *2.0 | 70 | ineffective | | |
| (2) | Steel plate | $FeCl_2$ . 4 aq, 150 (0.75) | $CaCl_2$ . 2 aq, 112 | *— | 3.0–3.7 | 35 | ineffective | | |
| (3) | Steel plate | $FeSO_4$ . 7 aq, 150 (0.54) | $Na_2SO_4$, 100 | *— | 3.0–3.5 | 25 | ineffective | | |
| (4) | Steel plate | $FeCl_2$ . 4 aq, 150 (0.75) | *$NH_4Cl$, 50 | Dextrin, 5 | 3.5–4.5 | 70 | 0.15 | 0.18 | 0.18 |
| (5) | Steel plate | $FeCl_2$ . 4 aq, *9.3 (0.05)<br>$FeCl_3$ *11 (0.07) | — | Dextrin, 5 | *1.8–2.2 | 35 | ineffective | | |
| (6) | Steel plate | $FeCl_2$ . 4 aq, *9.3 (0.05)<br>$FeCl_2$ . 4 aq, *11 (0.07) | — | Dextrin, 5 | 2.2–2.8 | 35 | plated layer easily peeled off | | |
| (7) | Steel plate | $FeCl_2$ . 4 aq, *9.3 (0.05)<br>$FeCl_2$ . 4 aq, *11 (0.07) | — | Dextrin, 5 | 2.5 | 35 | plated layer easily peeled off | | |
| (8) | Steel plate | $FeCl_2$ . 4 aq, *9.3 (0.05) | — | Dextrin, 5 | 3.0–3.5 | | | | |
| (9) | Steel plate | $FeCl_2$ . 4 aq, *350 (1.76) | — | Dextrin, 5 | 3.0–3.5 | 70 | 0.03 | 0.05 | 0.06 |

TABLE II

| Ex. No. | Cathode sub-strate | Aqueous electroplating bath: Iron and cobalt salt, g/l (mol/l) | Auxiliary additive, g/l | Additive, g/l | pH | Temp. °C. | $H_2$ overvoltage lowering effect in (V), at current density (A/dm²) 10 | 20 | 30 |
|---|---|---|---|---|---|---|---|---|---|
| 101 | Steel plate | $FeCl_2$ . 4 aq, 150 (0.75)<br>$CoCl_2$ . 6 aq, 2 (0.008) | — | Dextrin 5 | 3.5–3.8 | 70 | 0.32 | 0.32 | 0.33 |
| 102 | Steel plate | $FeCl_2$ . 4 aq, 150 (0.75)<br>$CoCl_2$ . 6 aq, 10 (0.04) | — | Dextrin 5 | 3.2–3.5 | 70 | 0.32 | 0.33 | 0.34 |
| 103 | Steel plate | $FeCl_2$ . 4 aq, 150 (0.75)<br>$CoCl_2$ . 6 aq, 20 (0.08) | — | Dextrin 5 | 3.2–3.5 | 70 | 0.33 | 0.34 | 0.35 |
| 104 | Steel plate | $FeCl_2$ . 4 aq, 150 (0.75)<br>$CoCl_2$ . 6 aq, 40 (0.17) | — | Dextrin 5 | 2.8–3.2 | 70 | 0.29 | 0.30 | 0.30 |
| 105 | Steel plate | $FeCl_2$ . 4 aq, 50 (0.25)<br>$CoCl_2$ . 6 aq, 100 (0.42) | — | Dextrin 5 | 3.5–4.0 | 70 | 0.27 | 0.28 | 0.28 |
| 106 | Steel plate | $FeCl_2$ . 4 aq, 40 (0.20)<br>$CoCl_2$ . 6 aq, 40 (0.17) | — | Dextrin 5 | 3.5–3.8 | 70 | 0.33 | 0.33 | 0.34 |
| 107 | Steel plate | $FeCl_2$ . 4 aq, 150 (0.75)<br>$CoSO_4$ . 7 aq, 20 (0.07) | — | Dextrin 5 | 3.0–3.5 | 70 | 0.30 | 0.31 | 0.31 |

TABLE II-continued

| Ex. No. | Cathode sub-strate | Aqueous electroplating bath: Iron and cobalt salt, g/l (mol/l) | Auxiliary additive, g/l | Additive, g/l | pH | Temp. °C. | $H_2$ overvoltage lowering effect in (V), at current density (A/dm²) 10 | 20 | 30 |
|---|---|---|---|---|---|---|---|---|---|
| 108 | Steel plate | $FeCl_2$ . 4 aq, 75 (0.38)<br>$CoCl_2$ . 6 aq, 75 (0.32) | — | PEAEM 1 | 3.9–4.0 | 70 | 0.20 | 0.20 | 0.21 |
| 109 | Steel plate | $FeCl_2$ . 4 aq, 75 (0.38)<br>$CoCl_2$ . 6 aq, 75 (0.32) | — | PAC 1 | 3.0–3.2 | 70 | 0.16 | 0.16 | 0.17 |
| 110 | Steel plate | $FeCl_2$ . 4 aq, 150 (0.75)<br>$CoCl_2$ . 6 aq, 20 (0.08) | — | Dextrin 5 | 3.2–3.5 | 25 | 0.32 | 0.33 | 0.34 |
| 111 | Steel net | $FeCl_2$ . 4 aq, 150 (0.75)<br>$CoCl_2$ . 6 aq, 20 (0.08) | — | Dextrin 5 | 3.0–3.5 | 70 | — | 0.26 | — |
| 112 | Steel net | $FeCl_2$ . 4 aq, 150 (0.75)<br>$CoCl_2$ . 6 aq, 20 (0.08) | — | PEAEM 1 | 3.9–4.0 | 70 | — | 0.14 | — |
| 101 | Steel plate | $FeCl_2$ . 4 aq, 150 (0.75)<br>$CoCl_2$ . 6 aq, 10 (0.04) | — | *— | 2.8–3.5 | 70 | ineffective | | |
| (102) | Steel plate | $FeCl_2$ . 4 aq, *360 (1.81)<br>$CoCl_2$ . 6 aq, 21.5 (0.09) | $CaCl_2$ . 2 aq, 180 | *— | *1.2–1.4 | 70 | ineffective | | |
| (103) | Steel plate | $FeCl_2$ . 4 aq, 150 (0.75)<br>$CoCl_2$ . 6 aq, 20 (0.08) | — | Dextrin 5 | *1.0–1.2 | 70 | ineffective | | |

What we claim is:

1. A cathode for electrolysis of an aqueous solution of an alkali metal halide, said cathode being composed of a metallic substrate and a coating of iron metal or iron metal and cobalt metal deposited on its surface at a current density of 1 to 10 A/dm² and a temperature of 20° to 90° C. from an aqueous electroplating bath consisting essentially of an aqueous solution having a pH value of from 2.5 to 6.0 containing therein (i) a metallic ion of $Fe^{++}$ or $Fe^{++}$ together with $Co^{++}$ in an amount of 0.5 to 0.9 moles/liter, and (ii) an additive selected from the group consisting of dextrin, water-soluble starch, poly(2-diethylaminoethyl methacrylate) and poly-aluminum chloride, said additive being employed at a concentration of 0.5 to 10 g/liter and said bath being free from an ammonium ion.

2. The cathode of claim 1 wherein the amount of the $Co^{++}$ ion is up to about 8 moles per mole of $Fe^{++}$ ion.

3. The cathode of claim 1 wherein the amount of the $Co^{++}$ ion is from 0.1 to 0.5 mole per mole of $Fe^{++}$ ion.

4. The cathode of claim 1 wherein the pH of the aqueous electroplating bath is 3 to 5.

5. The cathode of claim 1 wherein said metallic ion is derived from an iron (II) salt or an iron (II) salt together with a cobalt (II) salt dissolved in said bath.

6. The cathode of claim 1 wherein the metallic substrate is selected from iron, stainless steel, nickel, titanium and platinum-group metals.

7. In the process for electrolysis of an aqueous solution of an alkali metal halide, the improvement which comprises using a cathode for the electrolysis of an aqueous solution of an alkali metal halide, said cathode being composed of a metallic substrate and a coating of iron metal or iron metal and cobalt metal deposited on its surface at a current density of 1 to 10 A/dm² and at a temperature of 20° to 90° C. from an aqueous electroplating bath consisting essentially of an aqueous solution having a pH value of from 2.5 to 6.0 containing therein (i) a metallic ion of $Fe^{++}$ or $Fe^{++}$ together with $Co^{++}$ in an amount of 0.5 to 0.9 mole/liter, and (ii) an additive selected from the group consisting of dextrin, water-soluble starch, poly(2-diethylaminoethyl methacrylate) and poly-aluminum chloride, said additive being employed at a concentration of 0.5 to 10 g/liter and said bath being free from an ammonium ion.

8. The process of claim 7 wherein the amount of the $Co^{++}$ ion is up to about 8 moles per mole of $Fe^{++}$ ion.

9. The process of claim 7 wherein the amount of the $Co^{++}$ ion is from 0.1 to 0.5 mole per mole of $Fe^{++}$ ion.

10. The process of claim 7 wherein the pH of the aqueous electroplating bath is 3 to 5.

11. The process of claim 7 wherein said metallic ion is derived from an iron (II) salt or an iron (II) salt together with a cobalt (II) salt dissolved in said bath.

12. The process of claim 7 wherein the metallic substrate is selected from iron, stainless steel, nickel, titanium and platinum-group metals.

* * * * *